US012102279B2

(12) United States Patent
Longo et al.

(10) Patent No.: US 12,102,279 B2
(45) Date of Patent: Oct. 1, 2024

(54) DISHWASHER WITH WASHING CHAMBER ACCESSIBLE VIA FIRST AND SECOND LATERAL ZONES

(71) Applicant: Electrolux Professional S.p.A., Pordenone (IT)

(72) Inventors: Deny Longo, Pordenone (IT); Diego Favret, Pordenone (IT); Francesco Lillo, Pordenone (IT); Sandro Gerotto, Pordenone (IT); Gianni Moretto, Pordenone (IT)

(73) Assignee: Electrolux Professional S.p.A., Pordenone (IT)

( * ) Notice: Subject to any disclaimer, the term of this patent is extended or adjusted under 35 U.S.C. 154(b) by 0 days.

(21) Appl. No.: 18/061,842

(22) Filed: Dec. 5, 2022

(65) Prior Publication Data

US 2023/0101384 A1 Mar. 30, 2023

Related U.S. Application Data

(62) Division of application No. 17/467,624, filed on Sep. 7, 2021, now abandoned.

(30) Foreign Application Priority Data

Sep. 14, 2020 (EP) ..... 20196018

(51) Int. Cl.
*A47L 15/00* (2006.01)
*A47L 15/42* (2006.01)

(52) U.S. Cl.
CPC ..... *A47L 15/4257* (2013.01); *A47L 15/0065* (2013.01); *A47L 15/4278* (2013.01)

(58) Field of Classification Search
CPC ..... A47L 15/4257; A47L 15/0065; A47L 15/4278; A47L 15/0076; A47L 15/0078; A47L 15/0089; B08B 3/02; B08B 3/006
See application file for complete search history.

(56) References Cited

U.S. PATENT DOCUMENTS 1,502,131 A 7/1924 Vaudreuil
2,608,981 A * 9/1952 Jackson ..... A47L 15/23 134/91

(Continued)

FOREIGN PATENT DOCUMENTS

CN 106562747 A * 4/2017
CN 108618725 A * 10/2018 ..... A47L 15/22

OTHER PUBLICATIONS

European Patent Office, Examination Report issued in corresponding Application No. 20 196 018.4, dated Dec. 8, 2023.

*Primary Examiner* — David G Cormier
(74) *Attorney, Agent, or Firm* — Stites & Harbison, PLLC; David W. Nagle, Jr.

(57) ABSTRACT

A dishwasher (1) comprises a washing chamber (2) configured for receiving crockery (3) to be washed, which can be accessed via a first lateral zone (5*a*) and a distinct second lateral zone (5*b*). The dishwasher (1) includes a lid (6) configured for being rotated with respect to the washing chamber (2), around a rotation axis (7) passing through the washing chamber (2). In a first position, the lid (6) prevents accessing the washing chamber (2) both via the first lateral zone (5*a*) and via the second lateral zone (5*b*). In a second position, the lid (6) allows accessing the washing chamber (2) only via said first lateral zone (5*a*). In a third position, the lid (6) allows accessing said washing chamber (2) only via the second lateral zone (5*b*).

9 Claims, 11 Drawing Sheets

(56) References Cited

U.S. PATENT DOCUMENTS

| | | | | |
|---|---|---|---|---|
| 2005/0072449 | A1* | 4/2005 | Alpert | A47L 15/46<br>134/25.1 |
| 2016/0324997 | A1* | 11/2016 | Dayton | A61L 2/10 |
| 2021/0308301 | A1* | 10/2021 | Sperry | A61L 2/24 |

* cited by examiner

DISHWASHER WITH WASHING CHAMBER ACCESSIBLE VIA FIRST AND SECOND LATERAL ZONES

CROSS-REFERENCE TO RELATED APPLICATIONS

The present application is a divisional of U.S. patent application Ser. No. 17/467,624 filed on Sep. 7, 2021 and claims priority to European Patent Application No. 20196018.4 filed on Sep. 14, 2020.

BACKGROUND OF THE INVENTION

The present invention refers to a dishwasher.

Nowadays, in public places where food and/or drinks are served, for example coffee bars, pubs, restaurants, canteens, etc., there is typically the need of washing, in a quick and reliable way, the crockery wherein the food and/or drinks are served.

For this purpose, most of such public places are provided with a dishwasher having a washing chamber wherein the crockery is loaded and automatically washed and rinsed.

Typically, such public places are provided with a counter separating the part of the public place accessible to the customers from the part reserved to the operators.

Typically, the dishwasher is positioned behind and under the counter, so as to be accessible only by the operators.

Therefore, an operator has to bring the dirty crockery from the part of the public place accessible to the customers to the part reserved to the operators (i.e. behind the counter) in order to load the crockery into the dishwasher.

A problem of such known solutions is therefore that the operator needs relatively much time for loading the dishwasher, which could be particularly problematic, in particular in the busiest times, like, for example, breakfast time, lunchtime, dinner time.

A further drawback of such known solutions is that the space available to the operators behind and/or under the counter is typically relatively small, and therefore the loading/unloading of the dishwasher is quite uncomfortable, in particular since the door of the known dishwashers suitable for being installed under a counter opens by pivoting downwards with respect to the housing of the dishwasher, interposing between the washing chamber and the operator, and therefore keeping the latter relatively spaced from the washing chamber to be loaded/unloaded.

The aim of the present invention is therefore to provide a dishwasher that can be used in a public place and that allow to reduce the time required to an operator for loading the dishwasher.

Within this aim, a further object of the invention is providing a dishwasher that can be loaded/unloaded in a way more comfortable than the known solutions.

A further object of the present invention is providing a dishwasher that can be used also in a relatively limited space.

SUMMARY OF THE INVENTION

Above aim and objects are solved by a dishwasher comprising a washing chamber configured for receiving crockery to be washed, and which can be accessed via a first lateral zone and a distinct second lateral zone; the dishwasher comprises a lid configured for being rotated, with respect to the washing chamber, around a rotation axis passing through the washing chamber, between a first position, in which it prevents accessing the washing chamber both via the first lateral zone and via the second lateral zone, and a second position in which it allows accessing the washing chamber via at least one between the first lateral zone and the second lateral zone.

In an advantageous embodiment, the first lateral zone and the second lateral zone are located, with respect to the rotation axis, on diametrically opposed positions.

Advantageously, the lid is configured in such a way that, for being moved from the first position to the second position, it is rotated around the rotation axis by a rotation angle comprised between 45° and 135°, preferably equal to 90°.

In an advantageous embodiment, the lid is configured for allowing accessing the washing chamber via both the first lateral zone and the second lateral zone when the lid is in the second position.

Advantageously, the lid is provided with a first opening and with a second opening configured for being positioned, when the lid is in the second position, respectively at the first zone and at the second zone, in such a way that the washing chamber can be accessed via the first zone passing through the first opening, and via the second zone passing through the second opening.

Advantageously, the first opening and the second opening are located on the lid on diametrically opposed positions with respect to the rotation axis.

In a further advantageous embodiment, the lid is configured for:

- allowing accessing the washing chamber only via the first lateral zone when the lid is in the second position;
- being rotatable up to a third position, different from the second position and from the first position, in which it allows accessing the washing chamber only via the second lateral zone.

Advantageously, the lid is configured in such a way that, for being moved from the second position to the third position, it is rotated around the rotation axis by 180°.

Advantageously, the lid is provided with an access opening configured for being positioned, when the lid is in the second position, at the first zone, so that the washing chamber can be accessed via the first zone passing through the access opening, and, when the lid is in the third position, at the second zone, so that the washing chamber can be accessed via the second zone passing through the access opening.

In an advantageous embodiment, the dishwasher comprises, within the washing chamber, a rack configured for accommodating crockery on it; in a first advantageous embodiment, the rack is static with respect to the washing chamber, while in a further advantageous embodiment, the rack is advantageously rotatable with respect to the washing chamber around the rotation axis and operatively connected to the lid in such a way that the rack rotates within the washing chamber together with the lid.

Advantageously, the dishwasher may comprise an electromechanical actuator configured for automatically rotating the lid.

Advantageously, the dishwasher may comprise a washing and/or rinsing nozzle, contained in (and preferably, but not necessarily static with respect to) the washing chamber, configured for sprinkling washing and/or rinsing liquid on crockery contained in the washing chamber, preferably from above and/or laterally to the crockery.

Advantageously, the washing chamber is laterally delimited by the lid and by a first lateral portion, static with respect to the washing chamber, interposed between the first lateral zone and the second lateral zone of the washing chamber.

Advantageously, the washing chamber is further laterally delimited by a second lateral portion, static with respect to the washing chamber, interposed between the first lateral zone and the second lateral zone on the opposite side with respect to the first lateral portion.

The invention is also related to a method for operating a dishwasher according to the invention, comprising the following steps:

- rotating the lid until reaching a position allowing accessing the washing chamber via the first lateral zone;
- loading crockery within the washing chamber via the first lateral zone;
- rotating the lid until reaching the first position;
- activating the dishwasher for washing the crockery;
- rotating the lid until reaching a position allowing accessing the washing chamber via the second lateral zone;
- unloading the crockery from the washing chamber via the second lateral zone.

DESCRIPTION OF THE DRAWINGS

Other advantages and features of a dishwasher according to the present invention will be clear from the following detailed description, provided only as a not limitative example, in which.

In the figures, same parts are indicated with the same reference numbers.

In the figures, same parts are indicated with the same reference numbers.

DETAILED DESCRIPTION OF THE INVENTION

Figure 2:
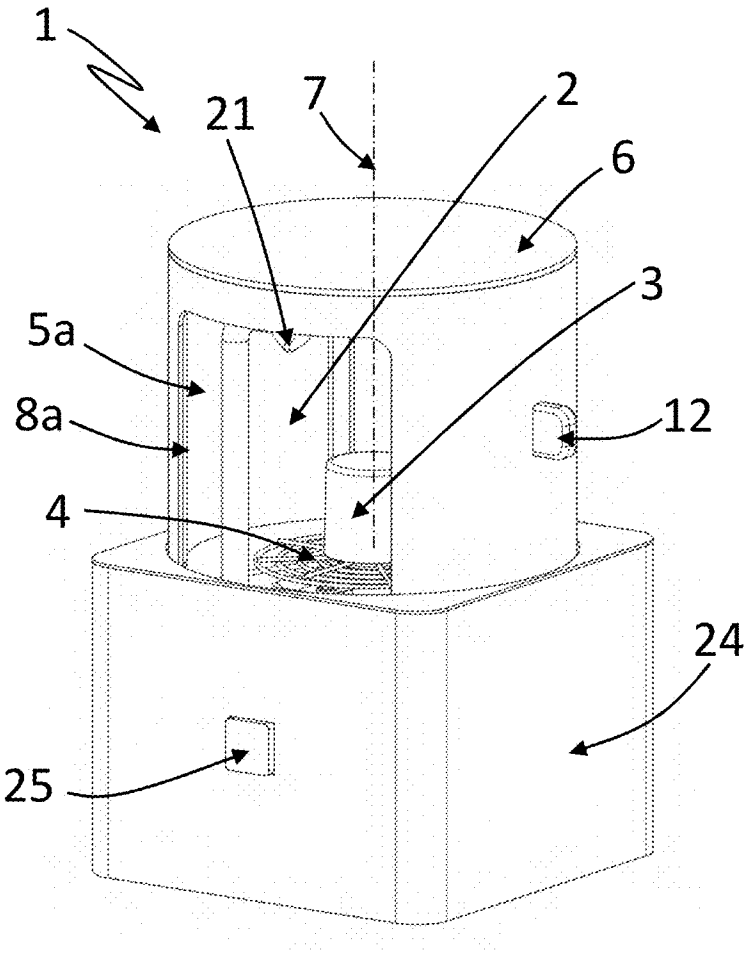
FIG. 2 is a prospective view of the dishwasher of FIG. 1, with the lid in the second position.
Figure 1:
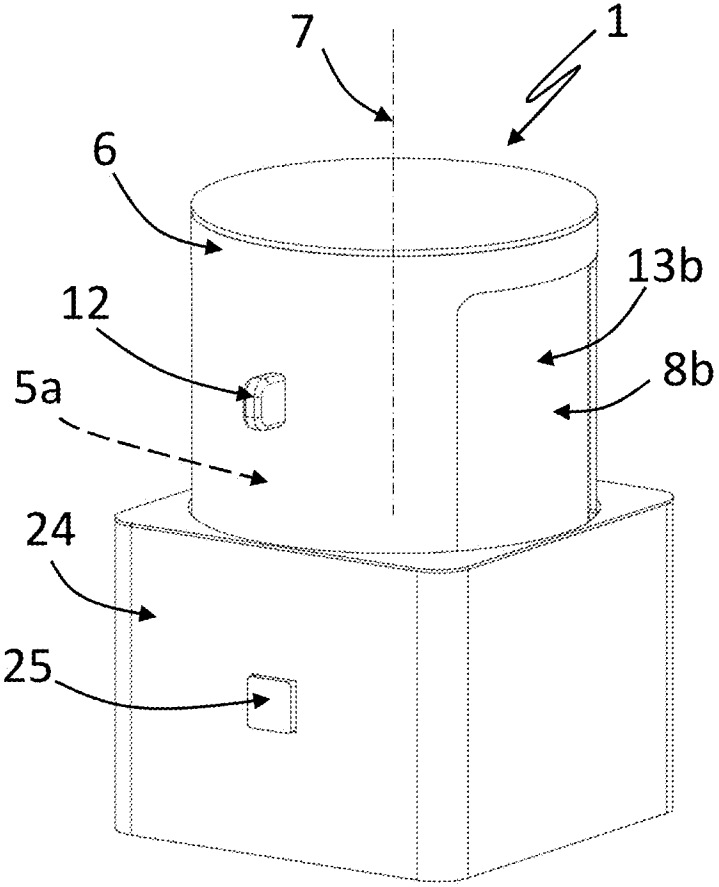
FIG. 1 is a prospective view of a first advantageous embodiment of a dishwasher according to the invention, with the lid in the first position.
Figure 4:
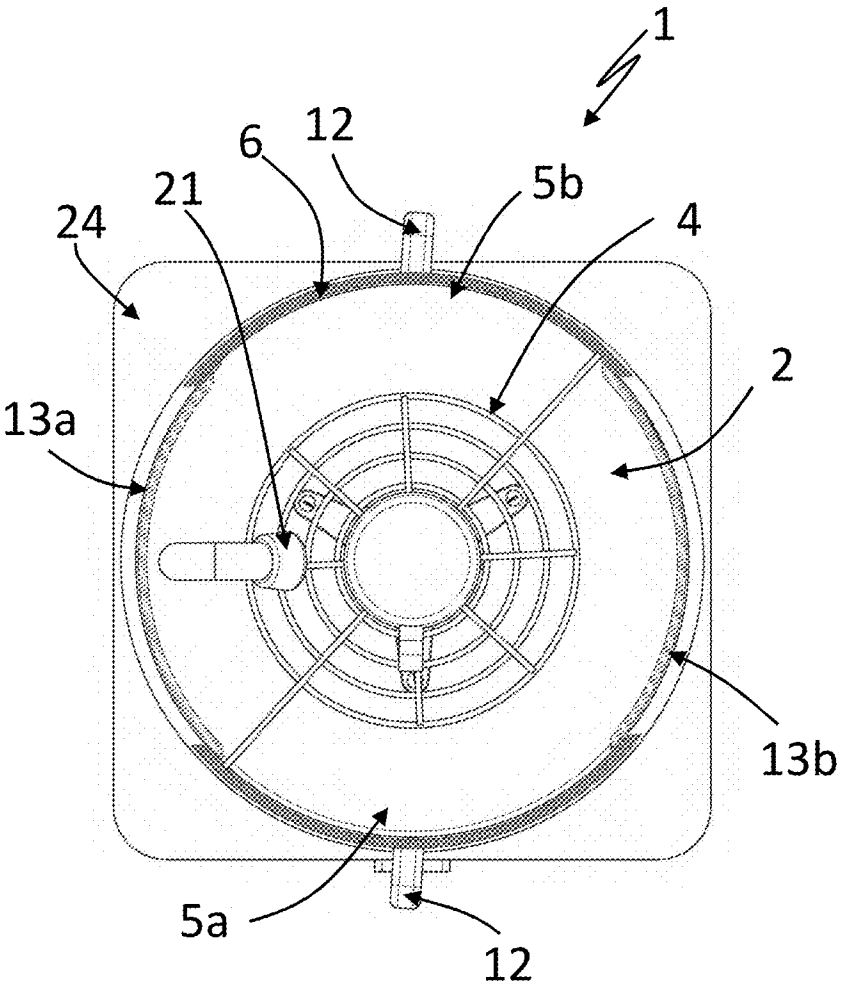
FIG. 4 is a cross section operated according to plane IV-IV of FIG. 3.
Figure 3:
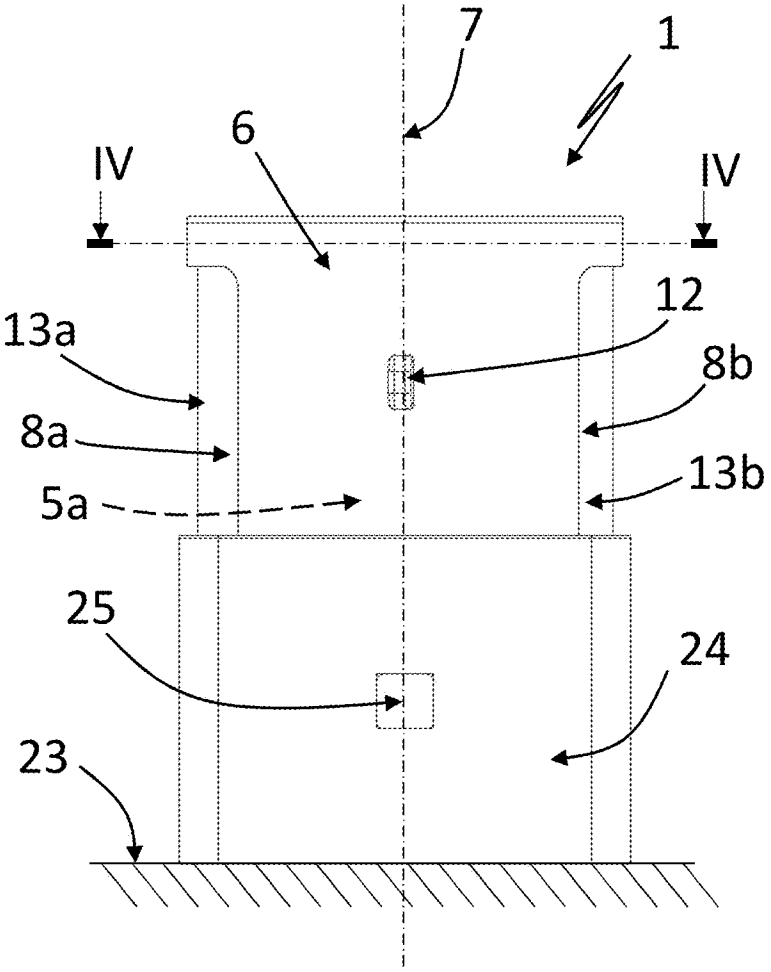
FIG. 3 is a frontal view of the dishwasher of FIGS. 1 and 2, with the lid in the first position.
Figure 6:
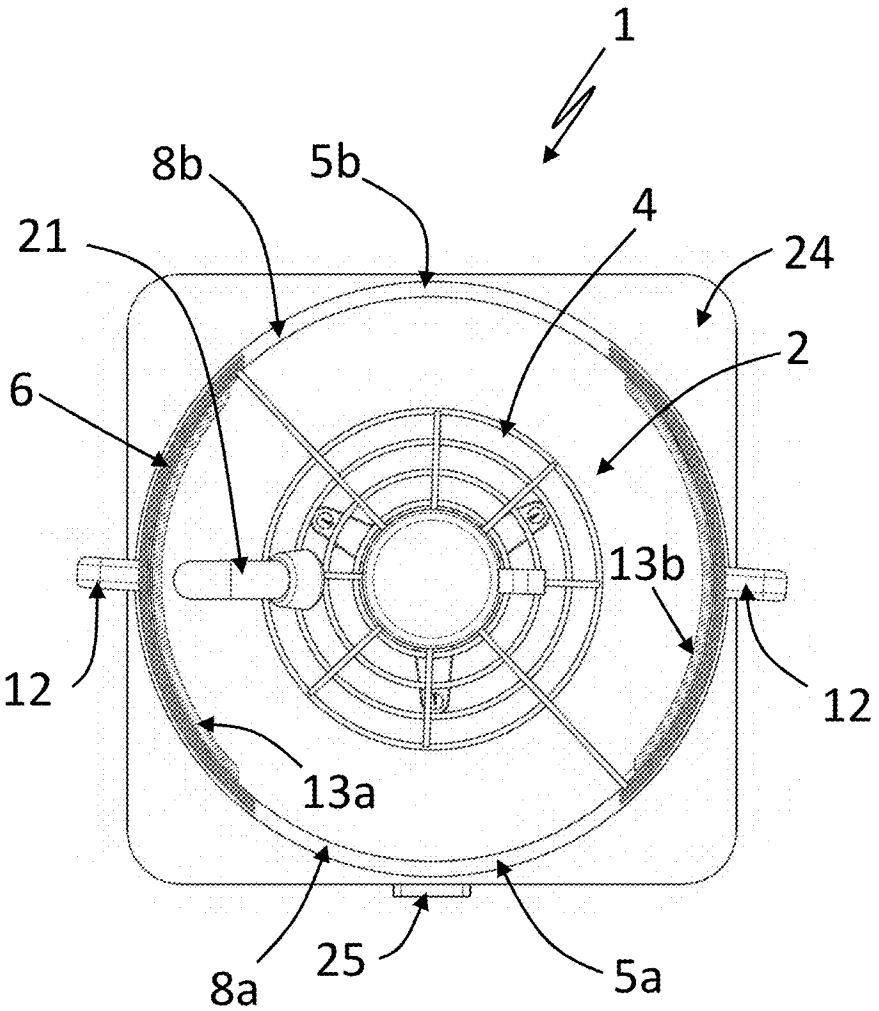
FIG. 6 is a cross section operated according to plane VI-VI of FIG. 5.
Figure 5:
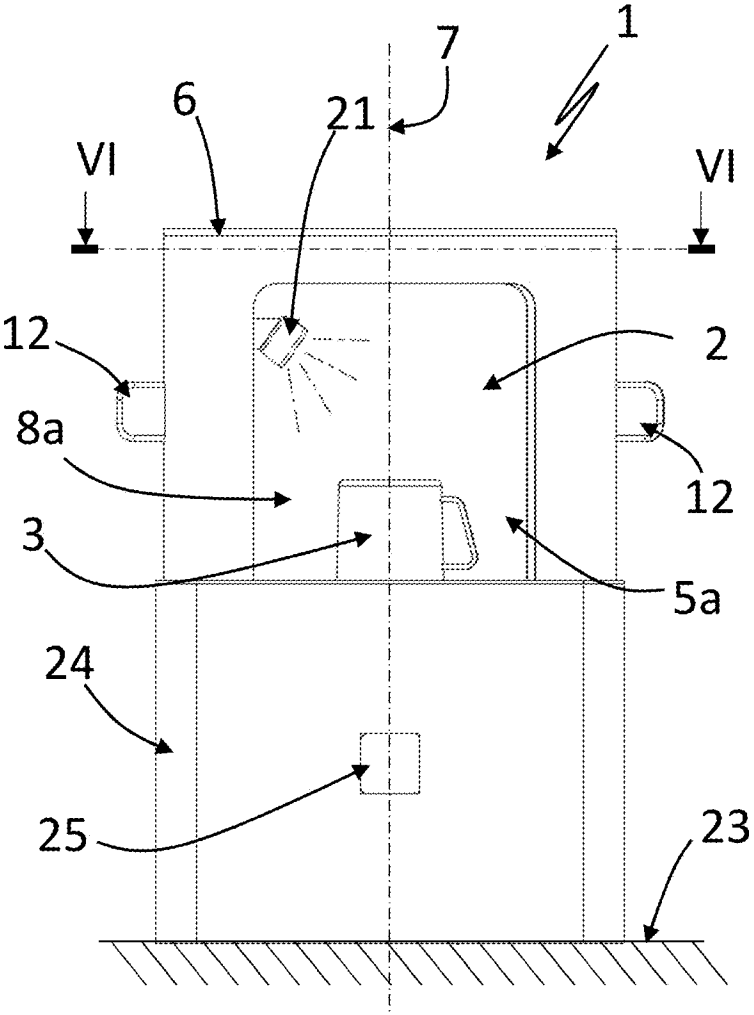
FIG. 5 is a frontal view of the dishwasher of the previous figures, with the lid in the second position.

A dishwasher 1 according to the invention comprises a washing chamber 2 configured for receiving crockery 3 to be washed, for example a cup (like in the advantageous embodiments illustrated in attached figures) and/or a glass and/or a dish, etc.

Advantageously, the dishwasher 1 comprises one or more racks, for example a single rack 4, like in the advantageous examples of attached figures, configured for accommodating crockery 3 on it.

In the advantageous embodiments illustrated in attached figures, the washing chamber 2 is advantageous dimensioned for receiving a single cup at a time; anyway, in other advantageous embodiments, not illustrated, the washing chamber 2 can be dimensioned for receiving a lot of crockery 3 at a time, for example positioned in a single rack 4, or in a plurality of racks, not illustrated, preferably arranged on top of each other.

The washing chamber 2 can be accessed via a first lateral zone 5*a*, and via a distinct second lateral zone 5*b*.

The dishwasher 1 comprises a lid 6 configured for being rotated, with respect to the washing chamber 2, around a rotation axis 7 passing through the washing chamber 2, between a first position, in which the lid 6 prevents accessing the washing chamber 2 both via the first lateral zone 5*a* and via said second lateral zone 5*b*, and a second position in which the lid 6 allows accessing the washing chamber 2 via at least one between the first lateral zone 5*a* and the second lateral zone 5*b*.

For example, in relation to a first advantageous embodiment of the invention, illustrated in FIGS. 1 to 8*a*, the lid 6 is illustrated in the first position in FIGS. 1, 3, 4 and 8*a*, and in the second position in FIGS. 2, 5, 6 and 8*b*.

In relation to a second advantageous embodiment of the invention, illustrated for example in FIGS. 9 to 20*b*, the lid 6 is illustrated in the first position in FIGS. 9, 12, 13, 19*a* and 20*a*, and in the second position in FIGS. 10, 14, 15 and 19*b*.

In advantageous embodiments, like for example the ones illustrated in attached figures, the rack 4 may be operatively connected to the lid 6 (for example by a suitable kinematic, not illustrated) in such a way that the rack 4 may rotate within the washing chamber 2 together with the lid 6.

In a further advantageous embodiment, the rack 4 is static with respect to the washing chamber 2.

In advantageous embodiments, like the ones illustrated in attached figures, the first lateral zone 5*a* and the second lateral zone 5*b* are located, with respect to the rotation axis 7, on diametrically opposed positions.

In a first advantageous embodiment, like the one illustrated for example in FIGS. 1 to 8*b*, the lid 6 is configured for allowing accessing the washing chamber 2 via both the first lateral zone 5*a* and the second lateral zone 5*b* when it is in the second position.

In this first advantageous embodiment, like illustrated for example in FIGS. 1 to 8*b*, the lid 6 is preferably provided with a first opening 8*a* and with a second opening 8*b* configured for being positioned, when the lid 6 is in the second position (as illustrated for example in FIGS. 6 and 8*b*), respectively at the first zone 5*a* and at the second zone 5*b*, in such a way that the washing chamber 2 can be accessed via the first zone 5*a* passing through the first opening 8*a*, and via the second zone 5*b* passing through the second opening 8*b*.

In this first advantageous embodiment, like illustrated for example in FIGS. 1 to 8*b*, the lid 6 is preferably configured in such a way that, for being moved from the first position (for example the position illustrated in solid lines in FIG. 8*a*) to the second position (for example the position illustrated in FIG. 8*b*, and in dotted lines in FIG. 8*a*), it has to be rotated around the rotation axis 7 by a first rotation angle α1 comprised between 45° and 135°, preferably equal to 90°.

Figure 8B:
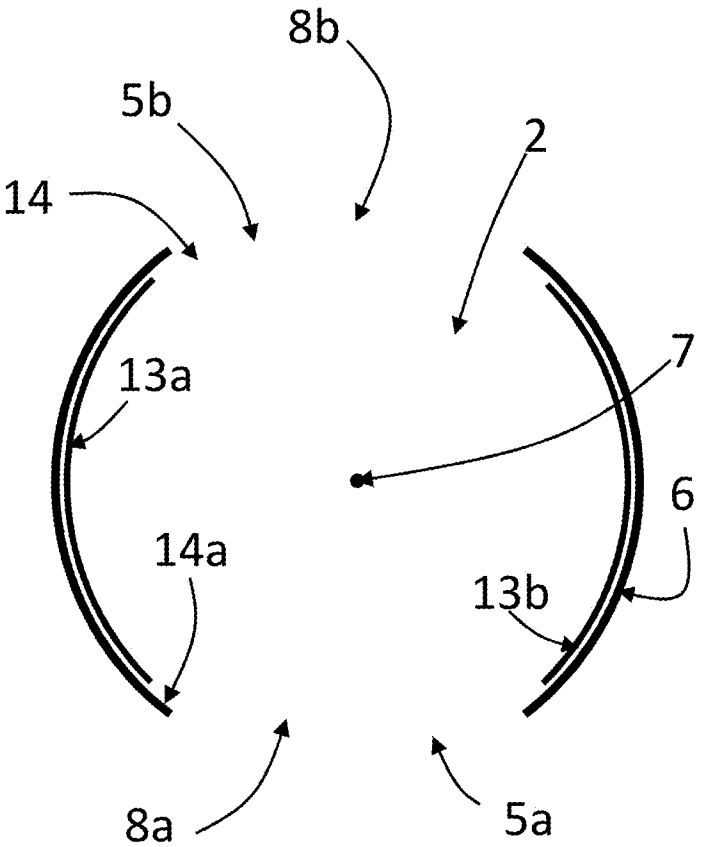
FIG. 8*b* is a schematic plane view of the lid of the dishwasher of the previous figures, in the second position.
Figure 8A:
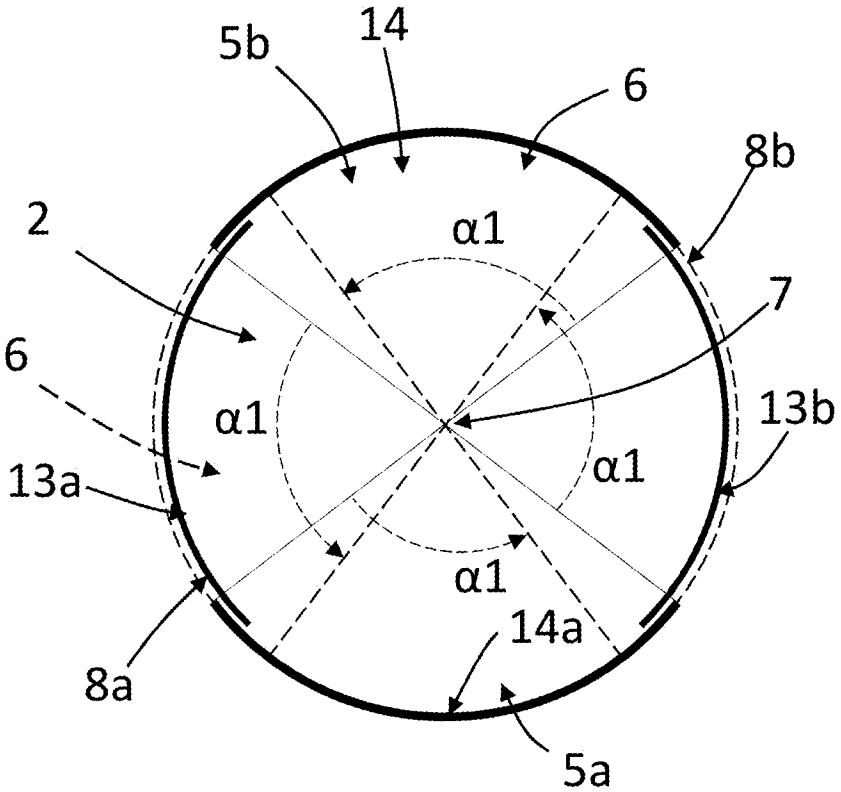
FIG. 8*a* is a schematic plane view of the lid of the dishwasher of the previous figures, in the first position.
Figure 11:
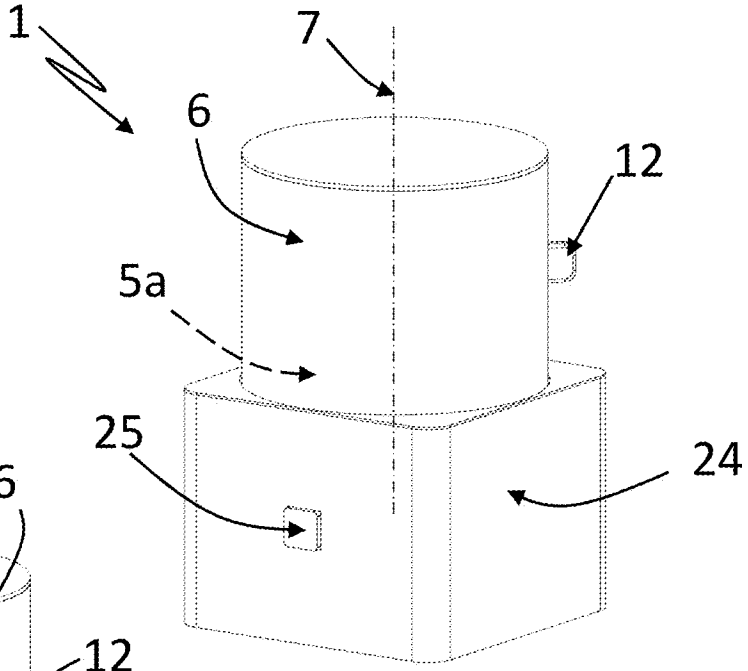
FIG. 11 is a prospective view of the dishwasher of FIGS. 9 and 10, with the lid in the third position.
Figure 10:
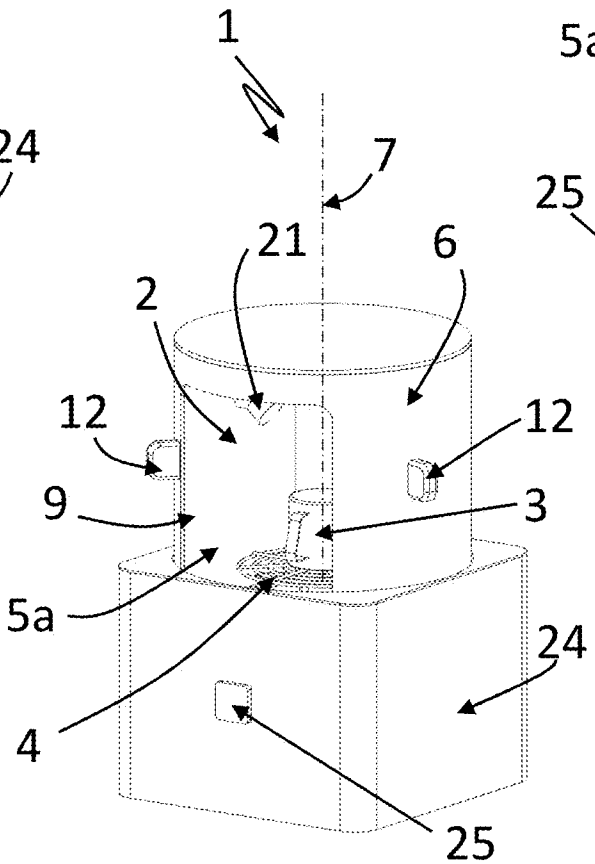
FIG. 10 is a prospective view of the dishwasher of FIG. 9, with the lid in the second position.
Figure 9:
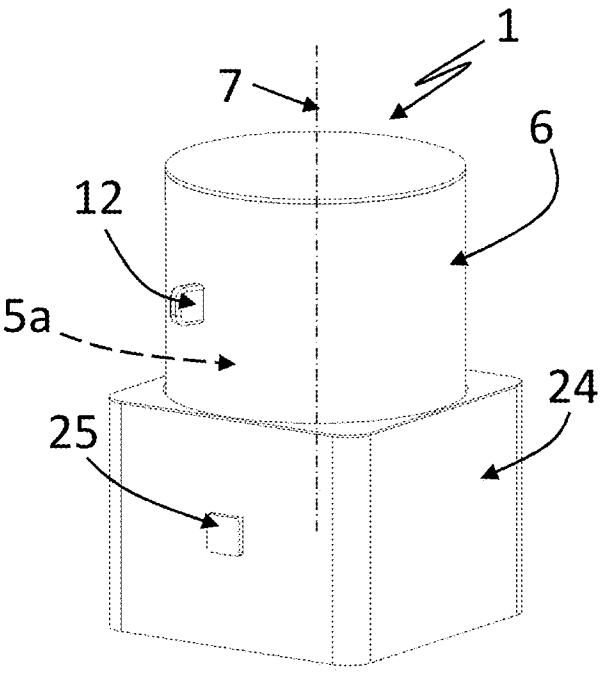
FIG. 9 is a prospective view of a second advantageous embodiment of a dishwasher according to the invention, with the lid in the first position.
Figure 13:
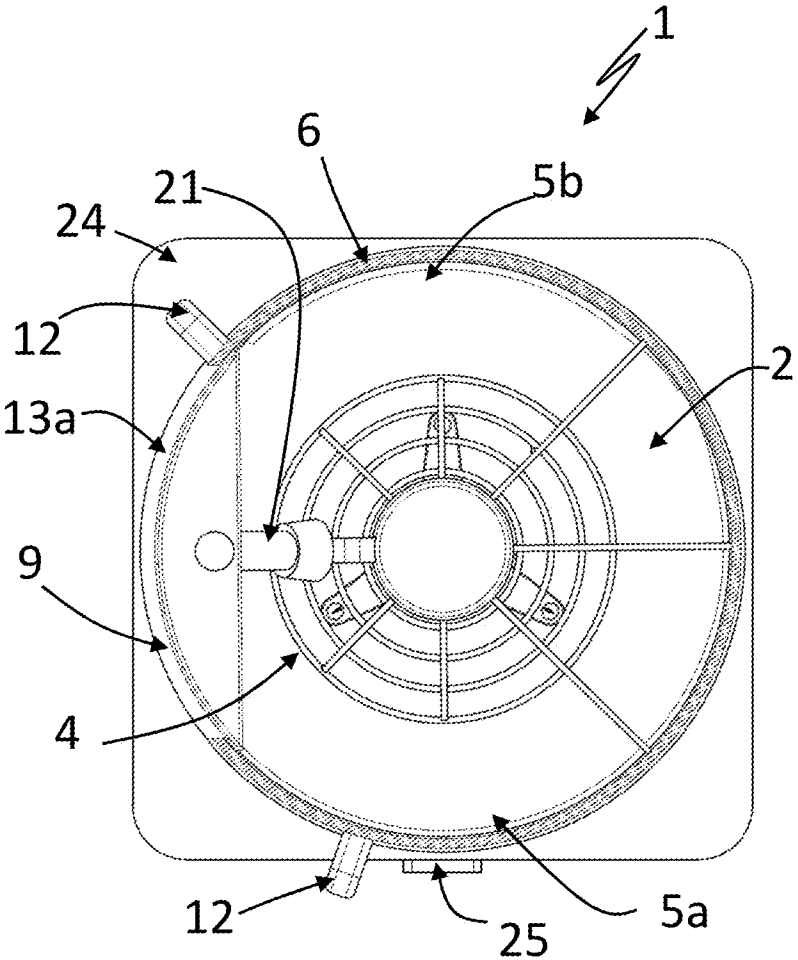
FIG. 13 is a cross section operated according to plane XIII-XIII of FIG. 12.
Figure 12:
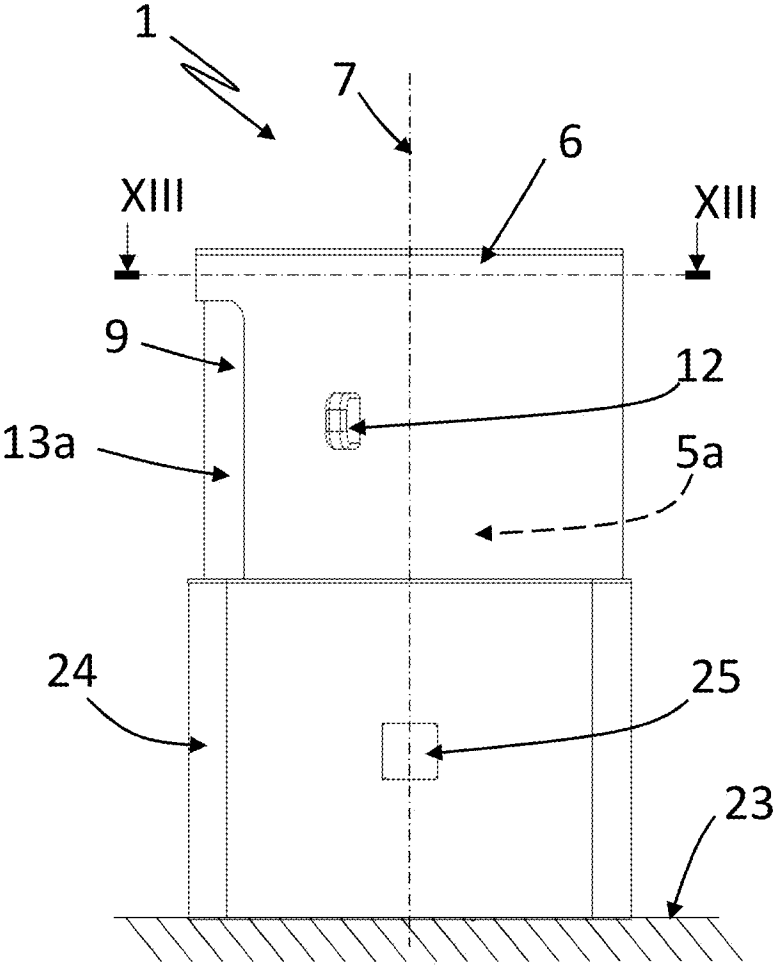
FIG. 12 is a frontal view of the dishwasher of FIGS. 9 to 11, with the lid in the first position.
Figure 15:
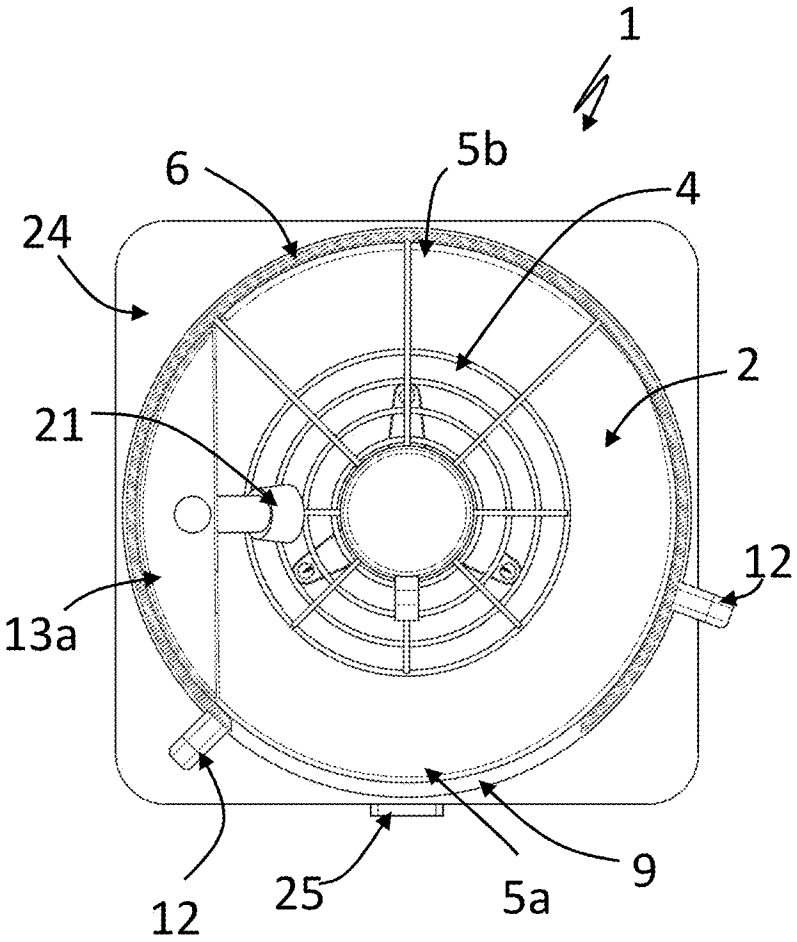
FIG. 15 is a cross section operated according to plane XV-XV of FIG. 14.
Figure 14:
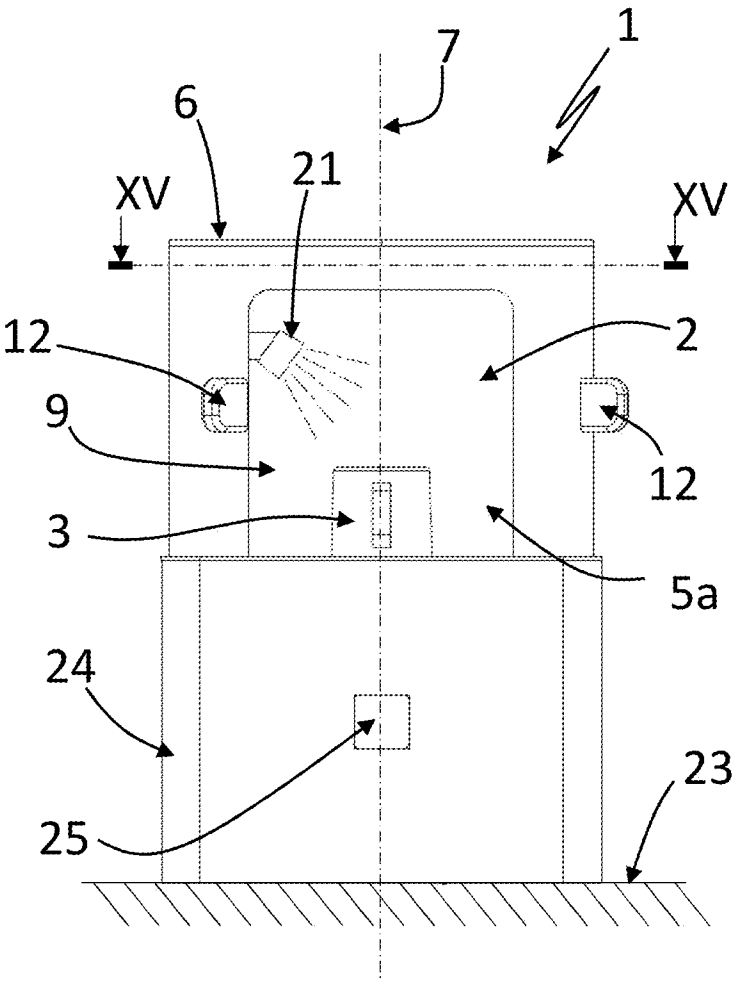
FIG. 14 is a frontal view of the dishwasher of FIGS. 9 to 13, with the lid in the second position.
Figure 17:
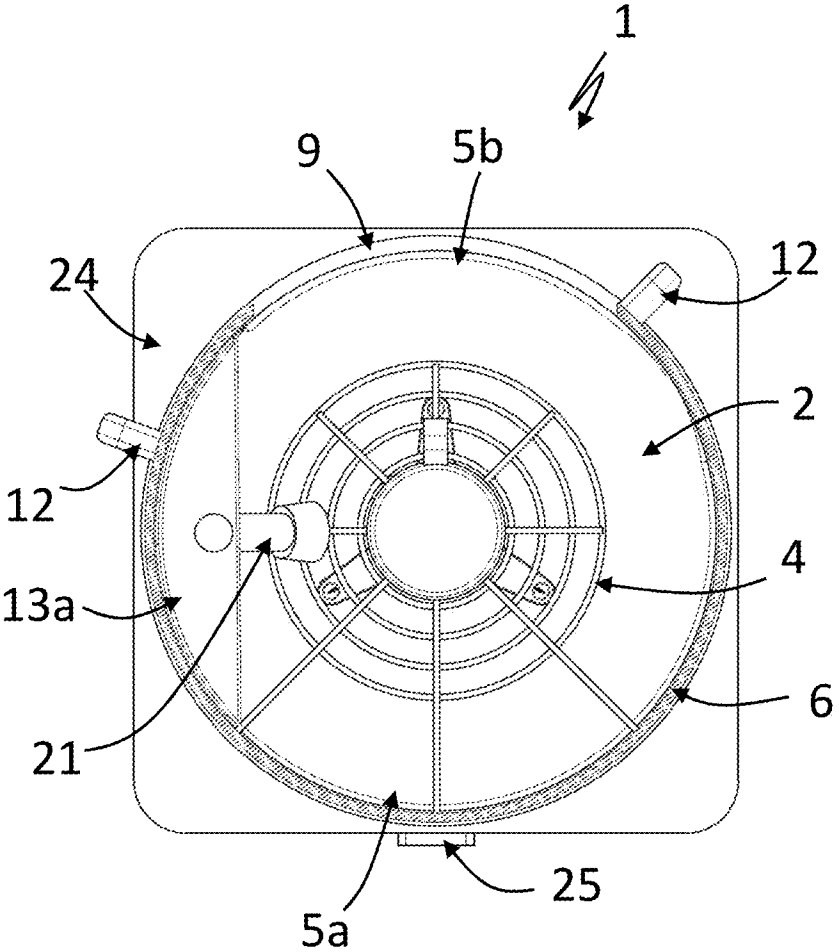
FIG. 17 is a cross section operated according to plane XVII-XVII of FIG. 16.
Figure 16:
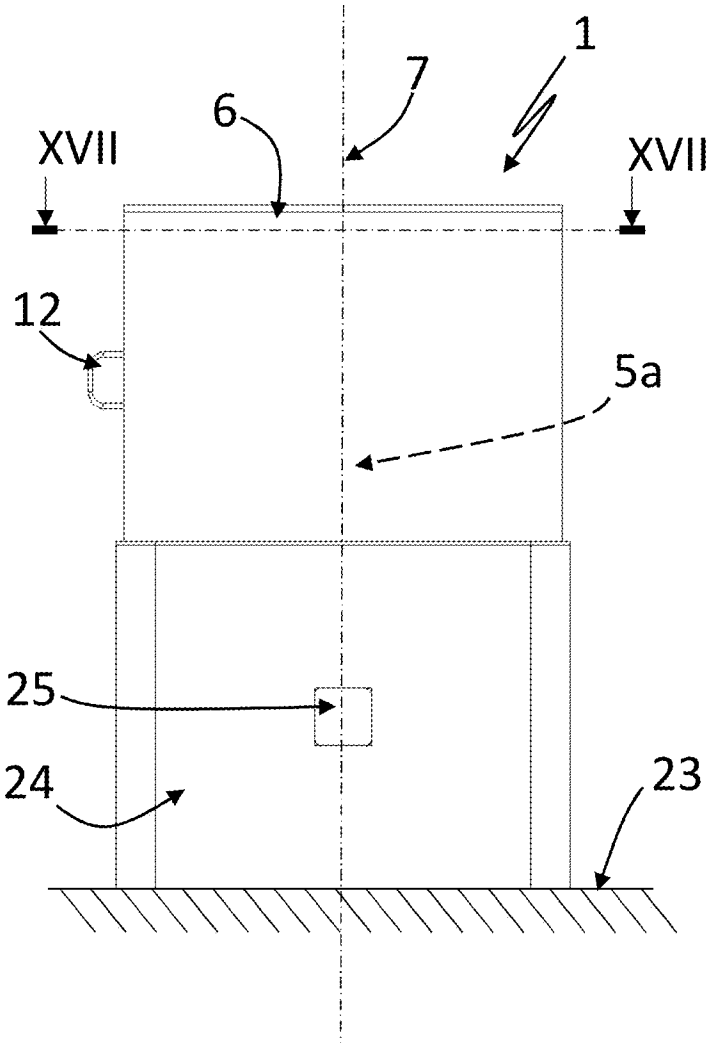
FIG. 16 is a frontal view of the dishwasher of FIGS. 9 to 15, with the lid in the third position.

Advantageously, the lid 6 can be configured in such a way that it can be taken from the first position to the second position both by a counterclockwise rotation, like in the examples of FIGS. 8*a*, 8*b*, or by a clockwise rotation.

In a further advantageous embodiment, the lid 6 can be configured in such a way that it can be taken from the first position to the second position both by a clockwise rotation and by a counterclockwise rotation.

In an advantageous embodiment, the lid 6 can be configured in such a way that it can be moved from the second position to the first position by a second rotation, in the opposite direction with respect to the rotation for taking the lid 6 from the first position to the second position, advantageously of the same first rotation angle α1.

In a further advantageous embodiment, the lid 6 can be configured in such a way that it can be moved from the second position to the first position, or to a further position in which it prevents accessing the washing chamber 2 both via the first lateral zone 5*a* and via said second lateral zone 5*b*, by a further rotation in the same direction of rotation used for taking the lid 6 from the first position to the second position, for example of a further first rotation angle α1 comprised between 45° and 135°, preferably equal to 90°.

In an advantageous embodiment, the lid 6 is configured for being kept in the first and/or in the second position by one or more end-of-stroke devices, not illustrated.

Preferably, in the advantageous embodiment in which the first lateral zone 5*a* and the second lateral zone 5*b* are located, with respect to the rotation axis 7, on diametrically opposed positions, the first opening 8*a* and the second opening 8*b* are located on the lid 6 on diametrically opposed positions with respect to the rotation axis 7.

In a second advantageous embodiment, like for example the one illustrated in FIGS. 9 to 20*b*, the lid 6 is configured for allowing accessing the washing chamber 2 only via the first lateral zone 5*a* when it is rotated in the second position (as illustrated for example in FIGS. 10, 14, 15 and 19*b*), and for being rotatable up to a third position (illustrated for example in FIGS. 11, 16, 17, 20*b*), different from the second position and from the first position, in which it allows accessing the washing chamber 2 only via the second lateral zone 5*b*.

Figure 19B:
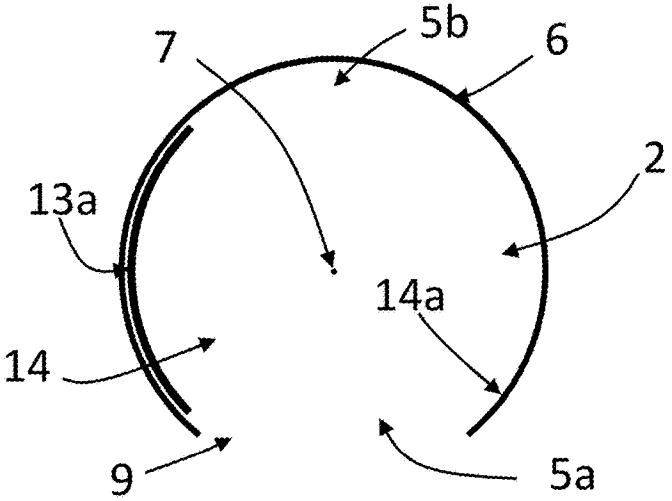
FIG. 19*b* is a schematic plane view of the lid of the dishwasher of FIGS. 9 to 18, in the second position.
Figure 19A:
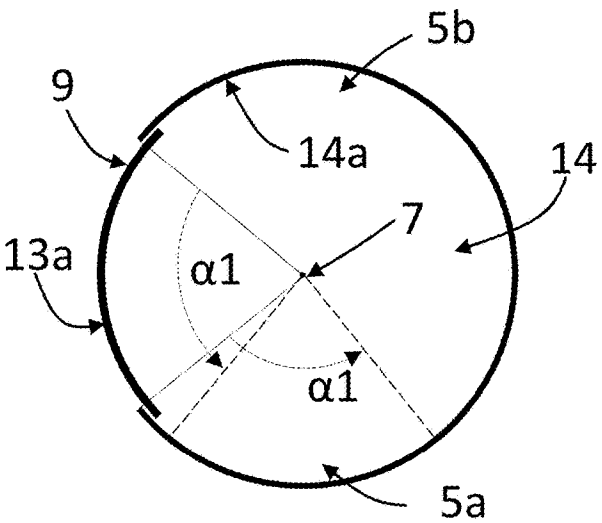
FIG. 19*a* is a schematic plane view of the lid of the dishwasher of FIGS. 9 to 18, in the first position.

In this second advantageous embodiment, like illustrated for example in FIGS. 19*a* and 19*b*, the lid 6 is preferably configured in such a way that, for being moved from the first position (for example the position illustrated in solid lines in FIG. 19*a*) to the second position (for example the position illustrated in FIG. 19*b*, and in dotted lines in FIG. 19*a*), it has to be rotated (preferably, like in the example of attached figures, but not necessarily, counterclockwise) around the rotation axis 7 by a first rotation angle α1 comprised between 45° and 135°, preferably equal to 90°.

In an advantageous embodiment, the lid 6 can be configured in such a way that it can be moved from the second position to the first position by a second rotation around the rotation axis 7, in the opposite direction with respect to the rotation for taking the lid 6 from the first position to the second position, advantageously of the same rotation angle α1.

Figure 20B:
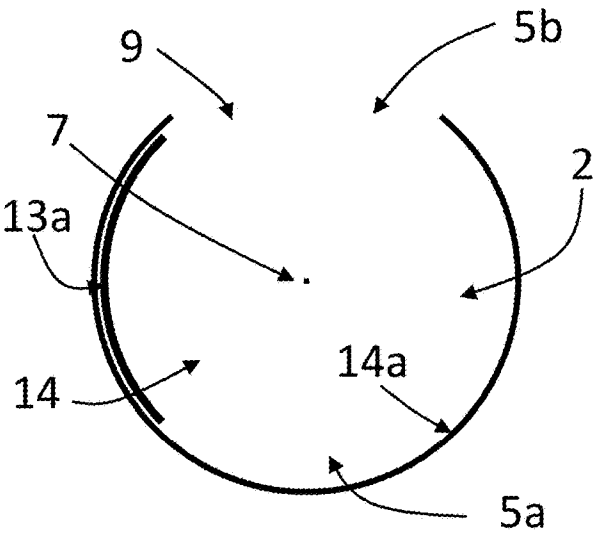
FIG. 20*b* is a schematic plane view of the lid of the dishwasher of FIGS. 9 to 18, in the third position.
Figure 20A:
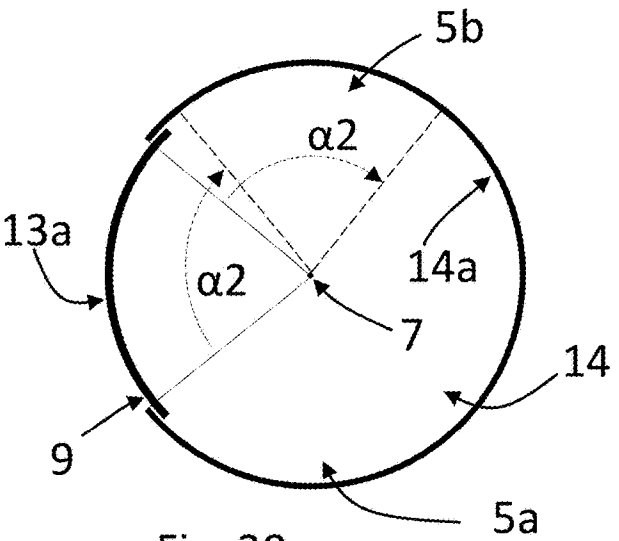
FIG. 20*a* is a schematic plane view of the lid of the dishwasher of FIGS. 9 to 18, in the first position.

In this second advantageous embodiment, like illustrated for example in FIGS. 20*a* and 20*b*, the lid 6 is preferably configured in such a way that, for being moved from the first position (for example the position illustrated in solid lines in FIG. 20*a*) to the third position (for example the position illustrated in FIG. 20*b*, and dotted lines in FIG. 20*a*), it has to be rotated around the rotation axis 7 by a second rotation angle α2, opposite to the first rotation angle α1, comprised between 45° and 135°, preferably equal to 90°.

In an advantageous embodiment, the lid 6 can be configured in such a way that it can be moved from the third position to the first position by a rotation around the rotation axis 7, in the opposite direction with respect to the rotation for taking the lid 6 from the first position to the third position, advantageously of the second rotation angle α2.

In an advantageous embodiment, like for example the one illustrated in FIGS. 9 to 20*b*, the lid 6 is configured in such a way that, for being moved from the second position to the third position, or vice versa, it has to be rotated around the rotation axis 7 by 180°.

In an advantageous embodiment, the lid 6 is configured for being kept in the third position by one or more end of stroke devices, not illustrated.

In the second advantageous embodiment, illustrated for example in FIGS. 9 to 20*b*, the lid 6 is provided with an access opening 9 configured for being positioned, when the lid 6 is in the second position (illustrated for example in FIG. 19*b*), at the first zone 5*a*, so that the washing chamber 2 can be accessed via the first zone 5*a* passing through the access opening 9, and, when the lid 6 is in the third position (illustrated for example in FIG. 20*b*), at the second zone 5*b*, so that the washing chamber 2 can be accessed via the second zone 5*b* passing through the access opening 9.

Figure 7:
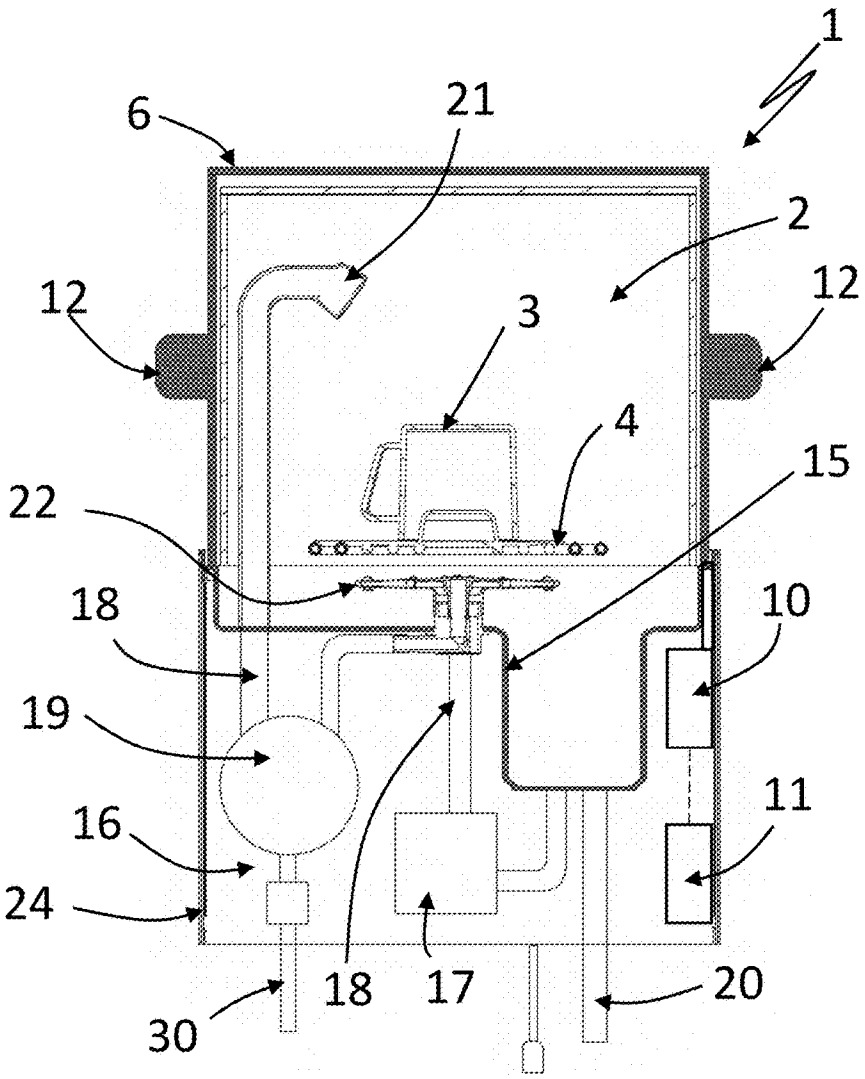
FIG. 7 is a lateral cross section of the dishwasher illustrated in the previous figures.
Figure 18:
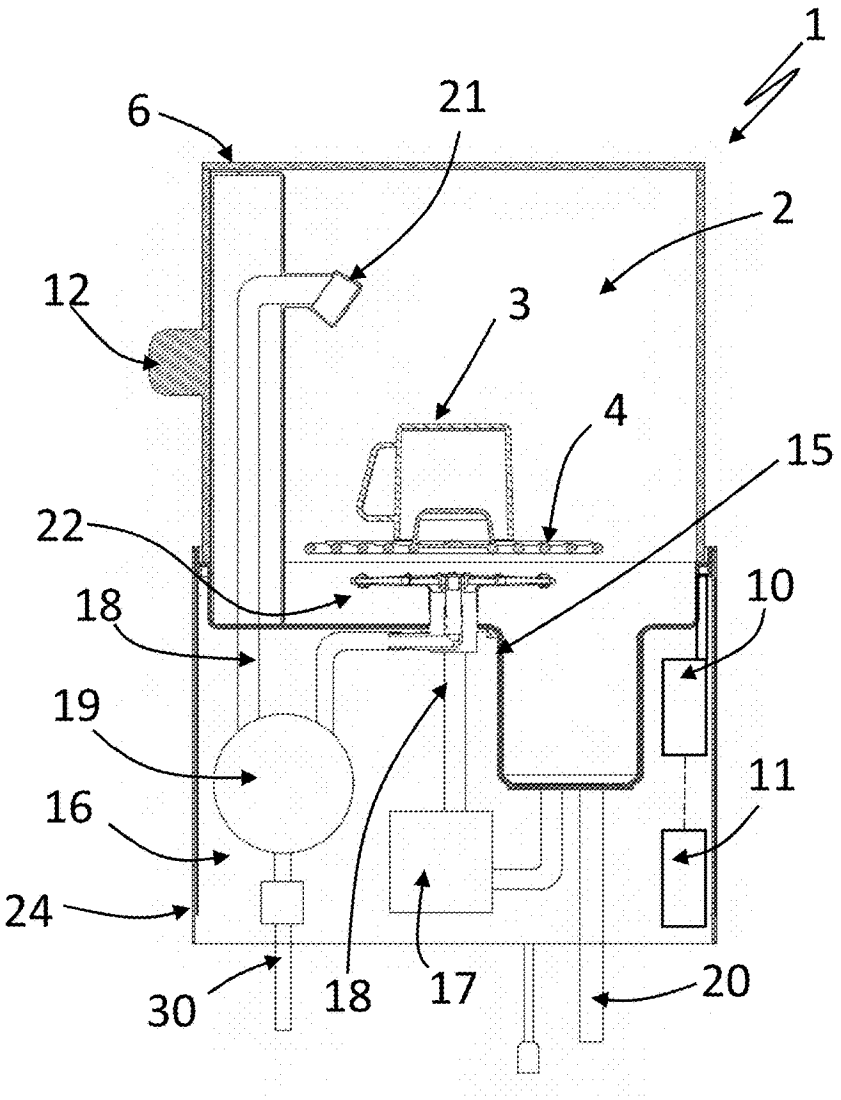
FIG. 18 is a lateral cross section of the dishwasher illustrated in FIGS. 9 to 17.

In an advantageous embodiment, the dishwasher 1 may comprise an electro-mechanical actuator 10, for example an electric motor, schematically illustrated in FIGS. 7 and 18, configured for automatically rotating the lid 6, so as to selectively take it automatically in the first position, in the second position and, if provided, in the third position.

In a preferred embodiment, the dishwasher 1 advantageously comprises an electronic control unit 11, schematically illustrated in FIGS. 7 and 18, configured for controlling the electric and electronic components of the dishwasher 1; preferably, the electro-mechanical actuator 10 is controlled by the electronic control unit 11.

In advantageous embodiments, like the ones illustrated in attached figures, the lid 6 is provided with one or more grasping devices, for example one or more handles 12, for facilitating the manual rotation of the lid 6 with respect to the washing chamber 2.

In advantageous embodiments, like for example the ones illustrated in attached figures, the dishwasher 1 comprises a user interface 25 (comprising for example a button, like in the advantageous examples of attached figures, and/or a knob, and/or a display, preferably a touch sensitive display), operatively connected to the electronic control unit 11 and configured for allowing a user to interact with the dishwasher 1, for example for programming and/or launching a washing program.

In advantageous embodiments, like for example the ones illustrated in attached figures, the washing chamber 2 is laterally delimited by the lid 6 and by a first lateral portion 13*a*, static with respect to the washing chamber 2, separating the first lateral zone 5*a* from the second lateral zone 5*b* of the washing chamber 2.

In a further advantageous embodiment, illustrated for example in FIGS. 1 to 8*b*, the washing chamber 2 is further laterally delimited by a second lateral portion 13*b*, static with respect to the washing chamber 2, separating the first lateral zone 5*a* from the second lateral zone 5*b*, on the opposite side with respect to the first lateral portion 13*a*; preferably, the second lateral portion 13*b* is diametrically opposed to the first lateral portion 13*a* with respect to the rotation axis 7.

In advantageous embodiments, like for example the ones illustrated in attached figures, the lid 6 is hollow and defines an internal volume 14, cylindrical or substantially cylindrical, which axis of symmetry advantageously coincides with the rotation axis 7.

In advantageous embodiments, the internal volume 14 of the lid 6 is laterally delimited by an internal surface 14*a*, and the washing chamber 2 is laterally delimited by the internal surface 14*a* and by the first lateral portion 13*a*.

In further advantageous embodiments, in which the dishwasher 1 is provided with both the first lateral portion 13*a* and the second lateral portion 13*b*, as for example the embodiment illustrated in FIGS. 9 to 20*b*, the washing chamber 2 is laterally delimited by the internal surface 14*a*, by the first lateral portion 13*a*, and by the second lateral portion 13*b*.

In advantageous embodiments, like the ones illustrated in attached figures, the washing chamber 2 comprises a lower tub 15 positioned below the region of the washing chamber 2 adapted to accommodate the crockery 3, so as to collect washing and/or rinsing liquid dripping from the crockery 3.

In advantageous embodiments, like the ones illustrated in attached figures, the lid 6 is configured for rotating with respect to the lower tub 15 around the rotation axis 7.

In advantageous embodiments, the dishwasher 1 comprises a washing and/or rinsing system 16 configured for circulating washing and/or rinsing liquid (e.g. water, or water mixed with a washing and/or rinsing additive) within the washing chamber 2 for washing and/or rinsing crockery 3 contained within the latter.

Preferably, the washing and/or rinsing system 16 is controlled by the electronic control unit 11.

In advantageous embodiments, the washing and/or rinsing system 16 comprises a pump 17, configured for circulating washing and/or rinsing liquid through pipes 18.

In advantageous embodiments, the washing and/or rinsing system 16 comprises a boiler 19, configured for heating the washing and/or rinsing liquid before delivering it on the crockery 3.

In advantageous embodiments, the washing and/or rinsing system 16 comprises an inlet duct 30, configured for being connected to water mains, not illustrated, external to the dishwasher 1, from which water can enter the washing and/or rinsing system 16.

In advantageous embodiments, the washing and/or rinsing system 16 comprises a drain conduit 20, configured for draining washing and/or rinsing liquid outside the washing chamber 2.

In advantageous embodiments, the washing and/or rinsing system 16 comprises a washing and/or rinsing nozzle 21, contained in, and preferably static with respect to the washing chamber 2, and configured for sprinkling washing and/or rinsing liquid on crockery 3 contained in the washing chamber 2, preferably from above and/or laterally to the crockery 3.

In advantageous embodiments, like for example the ones illustrated in attached figures, in which the washing and/or rinsing system 16 comprises a pump 17, the washing and/or rinsing nozzle 21 is advantageously fluidly connected to the pump 17, which is advantageously configured for delivering washing and/or rinsing liquid to the washing and/or rinsing nozzle 21.

In advantageous embodiments, like for example the ones illustrated in attached figures, in which the washing and/or rinsing system 16 comprises a boiler 19, the washing and/or rinsing nozzle 21 is advantageously fluidly connected to the boiler 19, so that the washing and/or rinsing nozzle 21 can sprinkle on the crockery 3 hot washing and/or rinsing liquid coming from the boiler 19; if the pump 17 is advantageously provided, the latter can be advantageously configured for moving the washing and/or rinsing liquid from the boiler to the washing and/or rinsing nozzle 21.

In advantageous embodiments, the washing and/or rinsing system 16 comprises, in addition or as an alternative to the washing and/or rinsing nozzle 21, a rotating spraying arm 22 contained in the washing chamber 2 and configured for rotating within the washing chamber 2 and for spraying one or more jets of washing and/or rinsing liquid against crockery 3 contained therein.

In advantageous embodiments, like for example the ones illustrated in attached figures, in which the washing and/or rinsing system 16 comprises a pump 17, the rotating spraying arm 22 is advantageously fluidly connected to the pump 17, which is advantageously configured for delivering washing and/or rinsing liquid to the rotating spraying arm 22.

In advantageous embodiments, like for example the ones illustrated in attached figures, in which the washing and/or rinsing system 16 comprises a boiler 19, the rotating spraying arm 22 is advantageously fluidly connected to the boiler 19, so that the rotating spraying arm 22 can sprinkle on the crockery 3 hot washing and/or rinsing liquid coming from the boiler 19; if the pump 17 is advantageously provided, the latter can be advantageously configured for moving the washing and/or rinsing liquid from the boiler to the rotating spraying arm 22.

In advantageous embodiments, like for example the ones illustrated in attached figures, the dishwasher 1 is configured for being positioned on a plane or substantially plane surface 23, for example the counter of a public place, perpendicular to the rotation axis 7.

In advantageous embodiments, like for example the ones illustrated in attached figures, the dishwasher 1 comprises a base 24 configured for being positioned on the plane or substantially plane surface 23 (preferably by suitable feet, not illustrated, protruding from a bottom region of the base 24) and for supporting the washing chamber 2.

Preferably, the lid 6 is slidably supported by the base 24, in such a way to rotate with respect to the latter around the rotation axis 7.

Preferably, the base 24 contains one or more components of the washing and/or rinsing system 16, and/or the electronic control unit 11.

The functioning of the dishwasher 1 is described in the following.

A user, for example an operator of a public place where food and/or drinks are served, for example a coffee bar, a pub, a restaurant, etc., or also directly a customer of such a public place having used crockery 3, can load such crockery 3, for example a cup, within the washing chamber 2 of the dishwasher 1 by rotating the lid 6 until reaching a position (for example the second position in the advantageous embodiments of FIGS. 1 to 8*a*, and of FIGS. 9 to 20*b*) allowing accessing the washing chamber 2 via the first lateral zone 5*a*.

Advantageously, if the dishwasher 1 is positioned on a counter of a public place, the dishwasher 1 can be positioned in such a way that the first lateral zone 5*a* faces the part of the public place accessible to the customers; in this way the user (operator and/or customer) can load the dirty crockery 3 without the need of taking it on the part of the public place reserved to the operators.

Once loaded the crockery 3, the lid 6 is rotated (e.g. manually, or by an electro-mechanical actuator, if provided) until reaching the first position, and the dishwasher 1 is activated for washing the crockery 3, according to a washing program, preferably memorized in the electronic control unit 11.

Advantageously, the dishwasher 1 can be configured in such a way to automatically activate a washing program when the lid 6 is taken in the first position; in a further advantageous embodiment, the dishwasher 1 is configured for activating a washing program after a user has performed an action (for example pressed a button) on a user interface 25.

Once the washing program is completed, the lid 6 can be rotated (e.g. manually, or by an electro-mechanical actuator, if provided) until reaching a position (for example the second position in the advantageous embodiment of FIGS. 1 to 8*a*, or the third position in the advantageous embodiment of FIGS. 9 to 20*b*) allowing accessing the washing chamber 2 via the second lateral zone 5*b*.

Then, the washed crockery 3 can be unloaded from the washing chamber 2 via the second lateral zone 5*b*.

Advantageously, if the dishwasher 1 is positioned on a counter of a public place, in such a way that the first lateral zone 5*a* faces the part of the public place accessible to the customers, and that the second lateral zone 5*b* faces the part of the public place reserved to the operators, an operator can unload the crockery 3 directly from the part of the public place reserved to the operators, where the clean crockery can be stored.

It is seen therefore how the invention achieves the proposed aim and objects, there being provided a dishwasher that, thanks to the possibility to access the washing chamber from two lateral zones, one of which can be positioned, for example, so as to face the part of the public place where the crockery is used (i.e. the part accessible to the customer), allows to reduce the time required to an operator for loading the dishwasher, since, for example, the user does not necessarily need to take the crockery from such part of the public place to the part of the public place reserved to the operators in order to load the dishwasher.

In addition, since the two distinct lateral zones via which the washing chamber can be accessed can be made accessible or not, simply by rotating a single lid, the dishwasher according to the invention can be loaded/unloaded in a way more easy and comfortable than the known solutions.

Since the dishwasher according to the invention is not provided with a door which opens by pivoting downwards with respect to the housing of the dishwasher, interposing between the washing chamber and the operator, the dishwasher according to the invention can be used also in a relatively limited space.

A further advantage of the present invention, in particular of the advantageous embodiment in which the lid is configured for allowing accessing the washing chamber via both the first lateral zone and the second lateral zone when such a lid is in the second position, is that it guarantees a high level of hygiene in case it is used for being loaded by a first person (e.g. a customer) from the first lateral zone, and for being unloaded by a different person (e.g. by an operator) from the second lateral zone; in fact, in this case, the first person and the second person, in order respectively to load and unload the washing chamber, can come into contact respectively with different regions of the dishwasher, reducing the risk of transmission of disease agents between such people.

The invention claimed is:

1. A dishwasher (1) comprising a washing chamber (2) configured for receiving crockery (3) to be washed, and which can be accessed via a first lateral zone (5*a*) and a distinct second lateral zone (5*b*), characterized in that:

it comprises a lid (6), which includes an access opening (9);

wherein said washing chamber (2) is laterally delimited by said lid (6) and by a first lateral portion (13*a*), static with respect to said washing chamber (2), interposed between said first lateral zone (5*a*) and said second lateral zone (5*b*) of said washing chamber (2), wherein said lid is configured for being rotated, with respect to said washing chamber (2), around a rotation axis (7) passing through said washing chamber (2), between a first position, in which it prevents accessing said washing chamber (2) both via said first lateral zone (5*a*) and via said second lateral zone (5*b*) as the first lateral portion 13(*a*) is aligned with and blocks the access opening (9), a second position in which it allows accessing said washing chamber (2) only via said first lateral zone (5*a*) passing through said access opening (9), and a third position, different from said second position and from said first position, in which it allows accessing said washing chamber (2) only via said second lateral zone (5*b*) passing through said access opening (9), and wherein access to said washing chamber (2) in the second position and access to said washing chamber (2) in the third position is achieved solely through rotation of the lid.

2. The dishwasher (1) as recited in claim 1, wherein said first lateral zone (5*a*) and said second lateral zone (5*b*) are located, with respect to said rotation axis (7), on diametrically opposed positions.

3. The dishwasher (1) as recited in claim 1, wherein said lid (6) is configured in such a way that, for being moved from said first position to said second position, it is rotated around said rotation axis (7) by a rotation angle ($\alpha$1) comprised between 45° and 135°.

4. The dishwasher (1) as recited in claim 1, wherein said first lateral zone (5*a*) and said second lateral zone (5*b*) are located, with respect to said rotation axis (7), on diametrically opposed positions; and wherein said lid (6) is configured in such a way that, for being moved from said second position to said third position, it is rotated around said rotation axis (7) by 180°.

5. The dishwasher (1) as recited in claim 1, comprising, within said washing chamber (2), a rack (4) configured for accommodating said crockery (3) on it, said rack (4) being static with respect to said washing chamber (2), or being rotatable with respect to said washing chamber (2) around said rotation axis (7) and being operatively connected to said lid (6) in such a way that said rack (4) rotates within said washing chamber (2) together with said lid (6).

6. The dishwasher (1) as recited in claim 1, comprising an electro-mechanical actuator (10) configured for automatically rotating said lid (6).

7. The dishwasher (1) as recited in claim 1, comprising a washing and/or rinsing nozzle (21), contained in said washing chamber (2), configured for sprinkling washing and/or rinsing liquid on said crockery (3) contained in said washing chamber (2).

8. The dishwasher (1) as recited in claim 1, wherein said washing chamber (2) is further laterally delimited by a second lateral portion (13*b*), static with respect to said washing chamber (2), interposed between said first lateral zone (5*a*) and said second lateral zone (5*b*) on an opposite side with respect to said first lateral portion (13*a*).

9. A method for operating the dishwasher (1) according to claim 1, comprising the following steps:

rotating said lid (6) until reaching said second position allowing accessing said washing chamber (2) via said first lateral zone (5*a*);

loading crockery (3) within said washing chamber (2) via said first lateral zone (5*a*);

rotating said lid (6) until reaching said first position;

activating said dishwasher (1) for washing said crockery (3);

rotating said lid (6) until reaching said third position allowing accessing said washing chamber (2) via said second lateral zone (5*b*); and unloading said crockery (3) from said washing chamber (2) via said second lateral zone (5*b*).

* * * * *